US006602837B1

(12) United States Patent
Patel

(10) Patent No.: US 6,602,837 B1
(45) Date of Patent: Aug. 5, 2003

(54) LIQUID AUTOMATIC DISHWASHING DETERGENT COMPOSITION CONTAINING DIACYL PEROXIDES

(75) Inventor: Rashesh Naresh Patel, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 08/728,337

(22) Filed: Oct. 9, 1996

Related U.S. Application Data

(63) Continuation of application No. 08/352,471, filed on Dec. 9, 1994, now abandoned.

(51) Int. Cl.[7] ..... C11D 3/02; C11D 7/02; C11D 3/395

(52) U.S. Cl. ..... 510/221; 510/226; 510/223; 510/230; 510/231; 510/232; 510/233; 510/372; 510/374; 510/375; 510/376; 510/392

(58) Field of Search ..... 510/221, 226, 510/228, 223, 230, 231, 232, 233, 372, 374, 375, 376

(56) References Cited

U.S. PATENT DOCUMENTS

| | | | | | |
|---|---|---|---|---|---|
| 2,955,905 | A | | 10/1960 | Davies et al. | 8/111 |
| 3,606,990 | A | | 9/1971 | Courbevoie et al. | 8/111 |
| 3,634,266 | A | | 1/1972 | Theile et al. | 252/232 |
| 4,025,453 | A | | 5/1977 | Kravetz et al. | 252/102 |
| 4,086,175 | A | | 4/1978 | Kravetz et al. | 252/99 |
| 4,086,177 | A | | 4/1978 | Kubitscheck et al. | 252/102 |
| 4,100,095 | A | | 7/1978 | Hutchins et al. | 252/99 |
| 4,151,106 | A | * | 4/1979 | Meenen | 252/95 |
| 4,154,695 | A | | 5/1979 | McCrudden et al. | 252/99 |
| 4,387,044 | A | | 6/1983 | Sanchez et al. | 252/426 |
| 4,530,766 | A | | 7/1985 | Hann et al. | 210/701 |
| 4,547,305 | A | | 10/1985 | Cornelissen et al. | 252/94 |
| 4,568,476 | A | | 2/1986 | Kielman et al. | 252/95 |
| 4,655,953 | A | | 4/1987 | Oakes | 252/99 |
| 4,720,353 | A | | 1/1988 | Bell | 252/309 |
| 4,988,363 | A | | 1/1991 | Barnes | 252/100 |
| 5,089,162 | A | | 2/1992 | Rapisarda et al. | 252/102 |
| 5,130,044 | A | | 7/1992 | Mitchell et al. | 252/102 |
| 5,130,045 | A | | 7/1992 | Mitchell et al. | 252/102 |
| 5,213,706 | A | | 5/1993 | Rapisarda et al. | 252/135 |
| 5,230,822 | A | * | 7/1993 | Kamel | 252/174.13 |
| 5,246,612 | A | | 9/1993 | Van Dijk et al. | 252/102 |
| 5,258,132 | A | * | 11/1993 | Kamel et al. | 510/370 |
| 5,314,639 | A | | 5/1994 | Torenbeek | 252/186.23 |
| 5,372,740 | A | * | 12/1994 | Fair | 252/135 |
| 5,388,474 | A | | 2/1995 | Tanaka et al. | 74/434 |
| 5,405,413 | A | * | 4/1995 | Willey | 8/111 |
| 5,480,577 | A | * | 1/1996 | Nicholson et al. | 510/222 |

FOREIGN PATENT DOCUMENTS

| | | | |
|---|---|---|---|
| EP | 0 239 379 A2 | 3/1987 | C11D/3/386 |
| EP | 0 295 093 A1 | 6/1988 | C11D/3/395 |
| EP | 0 337 535 A2 | 3/1989 | C11D/3/39 |
| EP | 0 504 091 A1 | 3/1992 | C11D/3/00 |
| GB | 1002893 | 9/1965 | |
| GB | 1 293 063 | 10/1972 | C11D/7/54 |
| WO | WO9519132 | 7/1995 | |

OTHER PUBLICATIONS

"The Stability of a Benzoyl Peroxide Acne Cream Product" published in the Canadian Journal of Pharmaceutical Sciences, Dec. 1967.

U.S. patent application Ser. No. 08/075,982, Ambuter et al., filed Jun. 11, 1993.

U.S. patent application Ser. No. 08/147,219, Sadlowski, filed Nov. 3, 1993.

U.S. patent application Ser. No. 08/147,222, You et al., filed Nov. 3, 1993.

U.S. patent application Ser. No. 08/147,224, Sadlowski, filed Nov. 3, 1993.

U.S. patent application Ser. No. 08/149,172, Marshall et al., filed Nov. 8, 1993.

U.S. patent application Ser. No. 08/172,627, Sadlowski, filed Dec. 23, 1993.

U.S. patent application Ser. No. 08/172,630, Sadlowski, filed Dec. 23, 1993.

U.S. patent application Ser. No. 08/226,929, Taylor et al., filed Apr. 13, 1994.

U.S. patent application Ser. No. 08/270,841, Gabriel et al., filed Jul. 5, 1994.

U.S. patent application Ser. No. 08/352,468, Patel et al., filed Dec. 9, 1994.

* cited by examiner

*Primary Examiner*—Gregory E. Webb
*Assistant Examiner*—Eisa Elhilo
(74) *Attorney, Agent, or Firm*—Kevin L. Waugh

(57) ABSTRACT

Alkaline liquid detergent compositions comprising a diacyl peroxide, solvent and chelant are disclosed. The solvent is preferably selected based upon the solubility parameter of the diacyl peroxide present. Preferred compositions are for use in automatic dishwashing detergents, are substantially phosphate free and contain detersive enzymes. The compositions are effective in removing stains, especially carotenoid, under various temperature and pH conditions from plastics.

22 Claims, No Drawings

LIQUID AUTOMATIC DISHWASHING DETERGENT COMPOSITION CONTAINING DIACYL PEROXIDES

This is a continuation of application Ser. No. 08/352,471, filed on Dec. 9, 1994, now abandoned.

TECHNICAL FIELD

The present invention is in the field of liquid detergents. More specifically, the invention relates to alkaline liquid automatic dishwashing detergents which provide enhanced cleaning, e.g. improved stain removal on plastics. The automatic dishwashing compositions comprise a diacyl peroxide which remains insoluble in a alkaline liquid automatic dishwashing detergent formulation by suspending the diacyl peroxide in a solvent having a solubility parameter value outside about ±4 of the diacyl peroxide's solubility parameter.

BACKGROUND OF THE INVENTION

Automatic dishwashing detergents (hereinafter ADDs) used for washing tableware (i.e. glassware, china, silverware, pots and pans, plastic, etc.) in the home or institutionally in machines especially designed for the purpose have long been known. Dishwashing in the seventies is reviewed by Mizuno in Vol. 5, Part III of the Surfactant Science-Series, Ed. W. G. Cutler and R. C. Davis, Marcel Dekker, N.Y., 1973, incorporated by reference. The particular requirements of cleansing tableware and leaving it in a sanitary, essentially spotless, residue-free state has indeed resulted in so many particular ADD compositions that the body of art pertaining thereto is now recognized as quite distinct from other cleansing product art.

In light of legislation and current environmental trends, modern ADD products desirably contain low levels or are substantially free of inorganic phosphate builder salts and/or are concentrated formulations (i.e. ½ cup vs. full cup usage). Unfortunately, phosphate or nonphosphated ADD products in technical terms may sacrifice efficacy, especially owing to the deletion of phosphate and, in some instances, chlorine mainstay cleansing ingredients. Concentrated or compact compositions similarly exhibit formulation problems.

Users of ADDs have come to expect tableware will be rendered essentially spotless and film-free in addition to cleaning. In practice, this means avoiding film-forming components. The formulator therefore employed ingredients which were sufficiently soluble that residues or build-up did not occur. Again, while some ingredients may be adequate on grounds of cleaning, spotting and filming, solubility considerations may diminish their usefulness. Solubility considerations are even more acute with the newer "low usage", "concentrated", ADD compositions whose overall solubility can be less than that of conventional ("full cup") products.

It has generally been believed by the formulator of ADDs that inexpensive cleaning can be achieved via high alkalinity and/or high silicate levels (for example as provided by formulations comprising high percentages by weight of sodium hydroxide or metasilicate). Severe penalties can result in these compositions in terms of product corrosiveness to dishwashers and tableware, especially china and glassware and incompatibility with other detergent ingredients. It is therefore highly desirable, at least in some phosphate-free compact ADDs, to achieve good cleaning end-results without resorting to the use of high alkalinity/high silicate. This is especially true for liquid formulations in that the alkaline conditions of the product can result in some of the ingredients losing activity over time, i.e. enzymes.

Chlorine and peroxygen bleaches are effective for stain and/or soil removal. While chlorine bleach is a very effective cleaning agent, it is not compatible with a variety of detergent ingredients and may require additional processing in order to be incorporated into a final product. Peroxygen bleaches on the other hand are more compatible with convention detergent ingredients but such bleaches are temperature and/or pH dependent. Also, formulation of liquid compositions require different approaches than granular product formulation. For instance, stability of bleaching agents and other individual ingredients over time in liquid products is much more difficult to achieve than in granular formulations. This is particularly true for diacyl peroxides in alkaline conditions. As a consequence, there has been a substantial amount of research to develop bleaching systems effective in various wash liquid formulations.

Another known bleaching source are diacyl peroxides (DAPs). Although DAPs have been disclosed for use in the laundry and anti-acne area, they have not been employed in the alkaline liquid or ADD area. In the laundry field certain diacyl peroxides have been disclosed as beneficial in cleaning tea stains from fibrous material. It has now been discovered that DAPs can improve stain removal performance of ADDs on plastics.

It is been further suprisingly discovered that DAPs can be provided in a alkaline liquid product by using certain combinations of solvents and chelants wherein the DAP remains insoluble.

It has yet been farther discovered that for stability and performance benefits the DAPs must remain insoluble in the ADD product.

The novel ADDs have the property of removing stains, especially tea, fruit juice and caretenoid stains objected to by the consumer from plastic dishware. The compositions have other cleaning and spotlessness advantages such as enhanced glass care (i.e. reduction of cloudiness and iridescence negatives). ADD embodiments including phosphate free compositions and enzyme-containing compositions are provided for powerful cleaning of wide-ranging soils while retaining the advantages of a generally mild and noncorrosive product matrix.

SUMMARY OF THE INVENTION

The present invention encompasses liquid alkaline detergent compositions especially thixotropic gel automatic dishwashing detergent compositions, comprising by weight:

(a) from about 0.01% to about 10%, preferably 0.1 to about 8%, more preferably from about 0.3% to about 5%, most preferably from about 0.8% to about 3% of diacyl peroxide having the general formula:

RC(O)OO(O)CR1 wherein R and R1 can be the same or different, preferably no more than one is a hydrocarbyl chain of longer than ten carbon atoms, more preferably at least one has an aromatic nucleus; and (b) from about 20% to about 90% solvent having a solubility parameter value outside about ±4 of the diacyl peroxide's solubility parameter; and (c) from about 0.01% to about 10% chelant, preferably said chelant is selected from the group consisting of polyacetate and polycarboxylate builders such as the sodium, potassium, lithium, ammonium and substituted ammonium salts of ethylenediamine tetraacetic acid, ethylenediamine disuccinic acid (especially the S,S-form); nitrilotriacetic acid, tartrate monosuccinic acid, tartrate disuccinic acid, oxydisuccinic acid, carboxymethyloxysuccinic acid, mellitic acid, sodium benzene polycarboxylate salts; nitrilotris(methylenephosphonic acid) diethylenetrinitrilopentakis(methylenephosphonic acid), 1-hydroxyethane-1,1-diphosphonic acid, ethylene-N,N'-bis(o-hydroxyphenylgycine), dipliolinic acid and mixtures thereof;

wherein said composition has a neat pH from about 7 to about 13.

While diacyl peroxide, solvent and chelant are the essential ingredients to the present invention, there are also provided embodiments wherein additional components, especially, enzymes, detergency builder and/or nonionic surfactant are desirably present. A particularly preferred embodiment comprises dibenzoyl peroxide.

The present invention also encompasses a method for cleaning soiled tableware comprising contacting said tableware with an aqueous medium having a pH in the range from about 8 to about 13, more preferably from about 9 to about 11.5, and comprising at least from about 0.01% to about 10% of a diacyl peroxide selected from the group consisting of dibenzoyl peroxide, benzoyl gluaryl peroxide, benzoyl succinyl peroxide, di-(2-methybenzoyl)peroxide, diphhthaloyl peroxide and mixtures thereof; and from about 20% to about 90% solvent selected from the group consisting of glycerol, dimethysiloxanes, sorbitol, water and mixtures thereof.

DETAILED DESCRIPTION OF THE INVENTION

A liquid, alkaline detergent composition comprising by weight:

a) from about 0.01% to about 10% of a diacyl peroxide having the general formula:

RC(O)OO(O)CR1 wherein R and R1 can be the same or different, preferably no more than one is a hydrocarbyl chain of longer than ten carbon atoms, more preferably at least one has an aromatic nucleus;

b) from about 20% to about 90% solvent having a solubility parameter value outside about ±4 of the said diacyl peroxide's solubility parameter;

c) from about 0.01% to about 10% chelant; and d) from about 0 to about 50% pH adjusting component;

wherein said composition has a neat pH measured of from about 7 to about 13.

A particularly preferred embodiment is phosphate free and further comprises from about 0.5% to about 12%, active detersive enzyme and from about 10% to about 60% detergency builder.

The term "wash solution" is defined herein to mean an aqueous solution of the product dissolved at 1,000–6,000 ppm, preferably at 2,500–4,500 ppm, in an automatic dishwasher.

Diacyl Peroxide Bleaching Species

The composition of the present invention, preferably liquid automatic dishwashing detergent compositions (LADDs) contain from about 0.01% to about 10% diacyl peroxide of the general formula:

RC(O)OO(O)CR1 wherein R and R1can be the same or different, preferably no more than one is a hydrocarbyl chain of longer than ten carbon atoms, more preferably at least one has an aromatic nucleus.

The preferred diacyl peroxides have a melting point greater than about 30° C., preferably greater than about 50° C., most preferably above 70° C. The preferred diacyl peroxides also have a particle size of greater than 10$\mu$, preferably from about 100$\mu$to about 2000$\mu$, more preferably from about 500$\mu$to about 1000$\mu$. Examples of suitable diacyl peroxides are selected from the group consisting of diacyl peroxide selected from the group consisting of dibenzoyl peroxide, benzoyl gluaryl peroxide, benzoyl succinyl peroxide, di-(2-methybenzoyl)peroxide, diphthaloyl peroxide, and mixtures thereof, more preferably dibenzoyl peroxide, dicumyl peroxide, diphthaloyl peroxides and mixtures thereof. A particulary preferred diacyl peroxide is dibenzoyl peroxide.

Solvent

The solvent of the present invention is of the type which the diacyl peroxide will not dissolve in. The preferred solvents are selected based upon the solubility parameter value of the diacyl peroxide employed.

The solubility parameter value of a compound is available from literature sources such as Polymer Handbook. Values obtained by experiments are preferred.

If the solubility parameter value is not available in the literature, the value can be calculated by using any of the methods described by Robert F. Fedor's article "A Method of Estimating Both the Solubility Parameters & Molar Volumes of Liquids", Polymer Engineering & Science, February, 1974, Vol 14, No. 2.

Once the solubility parameter value is obtained of the diacyl peroxide, solvents are selected having a solubility parameter which fall outside a +/− about 4 range of the diacyl peroxide solubility parameter.

For example, where the diacyl peroxide is benzoyl peroxide (solubility parameter value of 11.5) solvents with a solubility parameter of less than about 7.5 or greater than about 15.5 would be acceptable. Suitable solvents are selected from the group consisting of glycerol, dimethyl siloxanes, sorbitol, water and mixtures thereof, preferably sorbitol, and water.

Compositions of the present invention comprise by weight of the composition from about 20% to about 90% , preferably from about 25% to about 80%, more preferably from about 30% to about 60% of solvent(s).

A major portion of the solvent mixture should have solubility parameter value outside ±4 of DAP's solubility parameter. However, a solvent at levels, preferably <8%, more preferably <50% with solubility parameter close to DAP could be used as a mixture of preferred solvents (as described above), and may provide acceptable stability of DAP of interest.

Chelant

Heavy metal ion sequestrants (chelant) are useful components herein. By heavy metal ion sequestrants it is meant components which act to sequester (chelate) heavy metal ions. These components may also have calcium and magnesium chelation capacity, but preferentially they bind heavy metal ions such as iron, manganese and copper.

Heavy metal ion sequestrants are preferably present at a level of from 0.005% to 20%, more preferably from 0.05% to 10%, most preferably from 0.1% to 5% by weight of the compositions.

Heavy metal ion sequestrants, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water soluble. The molar ratio of said counter cation to the heavy metal ion sequestrant is preferably at least 1:1.

Suitable heavy metal ion sequestrants for use herein include the organo aminophosphonates, such as the amino alkylene poly(alkylene phosphonates) and nitrilo trimethylene phosphonates. Preferred organo aminophosphonates are diethylene triamine penta(methylene phosphonate) and hexamethylene diamine tetra(methylene phosphonate).

Other suitable heavy metal ion sequestrants for use herein include nitrilotriacetic acid and polyaminocarboxylic acids such as ethylenediaminotetracetic acid, ethylenetriamine pentacetic acid, or ethylenediamine disuccinic acid. Especially preferred is ethylenediamine-N,N'-disuccinic acid (EDDS), most preferably present in the form of its S,S isomer, which is preferred for its biodegradability profile.

Still other suitable heavy metal ion sequestrants for use herein are iminodiacetic acid derivatives such as 20 hydroxyethyl diacetic acid or glyceryl imino diacetic acid.

A preferred chelant of the detergent compositions herein is an organo diphosphonic acid or one of its salts/complexes.

The organo diphosphonic acid component may be present in its acid form or in the form of one of its salts or complexes with a suitable counter cation and reference hereinafter to the acid implicitly includes reference to said salts or complexes. Preferably any salts/complexes are water soluble, with the alkali metal and alkaline earth metal salts/complexes being especially preferred.

The organo diphosphonic acid is preferably a $C_1$–$C_4$ diphosphonic acid, more preferably a C2 diphosphonic acid, such as ethylene diphosphonic acid, or most preferably ethane 1-hydroxy-1,1-diphosphonic acid (HEDP).

pH-Adjusting Control Components

The compositions herein comprise a pH-adjusting component selected from water-soluble alkaline inorganic salts and water-soluble organic or inorganic builders. It has been discovered that to secure the benefits of the invention, the peroxygen bleaching component must at least be combined with a pH-adjusting component which delivers a wash solution pH of from 7 to about 13, preferably from about 9 to about 12, more preferably from about 9.5 to about 11.0. The pH-adjusting component are selected so that when the ADD is dissolved in water at a concentration of 2000–6000 ppm, the pH remains in the ranges discussed above. The preferred non phosphate pH-adjusting component embodiments of the invention is selected from the group consisting of (i) sodium/potassium carbonate or sesquicarbonate
(ii) sodium/potassium silicate, preferably hydrous sodium silicate having $SiO_2$:$Na_2O$ ratio of from about 1.:1 to about 2:1;
(iii) sodium/potassium citrate
(iv) citric acid
(v) sodium/potassium bicarbonate
(vi) sodium/potassium borate, preferably borax
(vii) sodium/potassium hydroxide; and
(viii) mixtures of (i)–(vii).

Preferred embodiments contain no or low levels of silicate (i.e. less than 10% $SiO_2$).

The amount of the pH adjusting component in the instant ADD compositions is generally from about 0.90% to about 99%, preferably from about 1% to about 50%, by weight of the composition. In a preferred embodiment, the pH-adjusting component is present in the ADD composition in an amount from about 5% to about 60%, preferably from about 10% to about 50%, by weight.

For compositions herein having a pH between about 9.5 and about 10.5 (i.e. the initial wash solution) particularly preferred ADD embodiments comprise, by weight of ADD, from about 5% to about 40%, preferably from about 10% to about 30%, most preferably from about 15% to about 20%, of sodium citrate with from about 5% to about 30%, preferably from about 7% to 25%, most preferably from about 8% to about 20% sodium carbonate.

The essential pH-adjusting system can be complemented (i.e. for improved sequestration in hard water) by other optional detergency builder salts selected from phosphate or nonphosphate detergency builders known in the art, which include the various water-soluble, alkali metal, ammonium or substituted ammonium borates, hydroxysulfonates, polyacetates, and polycarboxylates. Preferred are the alkali metal, especially, sodium, salts of such materials. Alternate water-soluble, non-phosphorus organic builders can be used for their sequestering properties. Examples of polyacetate and polycarboxylate builders are the sodium, potassium, lithium, ammonium and substituted ammonium salts of ethylenediamine tetraacetic acid, ethylenediamine disuccinic acid (especially the S,S-form); nitrilotriacetic acid, tartrate monosuccinic acid, tartrate disuccinic acid, oxydisuccinic acid, carboxymethyloxysuccinic acid, mellitic acid, and sodium benzene polycarboxylate salts. Water insoluble builder like zeolites can also be used as builders.

In general, pH values of the instant compositions can vary during the course of the wash as a result of the water and soil present. The best procedure for determining whether a given composition has the herein-indicated pH values is as follows: prepare an aqueous solution or dispersion of all the ingredients of the composition by mixing them in finely divided form with the required amount of water to have a 4000 ppm total concentration. Do not have any coatings on the particles capable of inhibiting dissolution. (In the case of the second pH adjusting component it should be omitted from the formula when determining the formula's initial pH value). Measure, the pH using a conventional glass electrode at ambient temperature, within about 2 minutes of forming the solution or dispersion. To be clear, this procedure relates to pH measurement and is not intended to be construed as limiting of the ADD compositions in any way; for example, it is clearly envisaged that fully-formulated embodiments of the instant ADD compositions may comprise a variety of ingredients applied as coatings to other ingredients, particularly the second pH adjusting component.

Thickener

Since the ADD compositions herein contain water-sensitive ingredients, e.g., diacyl peroxide and other preferred embodiments i.e. anhydrous amine oxides or anhydrous citric acid, it is desirable to keep the free moisture content of the ADDs at a minimum. The free moisture content of the present invention can be minimized by adding a polymeric thickener.

A suitable thickening agent are the viscoelastic, thixotropic thickening agents. The viscoelastic, thixotropic thickening agent in the compositions of the present invention is from about 0.1% to about 10%, preferably from about 0.25% to about 8%, most preferably from about 0.5% to about 5%, by weight of the detergent composition.

Preferably, the thickening agent is a polymer with a molecular weight at least about 500,000, preferably from about 500,000 to 10,000,000. Polymeric thickening agent can be, but is not limited to, a cross-linked polycarboxylate polymer.

The preferred cross-linked polycarboxylate polymer is preferably a carboxyvinyl polymer. Such compounds are disclosed in U.S. Pat. No. 2,798,053, issued on Jul. 2, 1957, to Brown, the specification of which is hereby incorporated by reference. Methods for making carboxyvinyl polymers are also disclosed in Brown. Carboxyvinyl polymers are substantially insoluble in liquid, volatile organic hydrocarbons and are dimensionally stable on exposure to air.

Preferred polyhydric alcohols used to produce carboxyvinyl polymers include polyols selected from the class consisting of oligosaccarides, reduced derivatives thereof in which the carbonyl group is converted to an alcohol group, a pentaerythritol; most preferred is sucrose or pentaerythritol. It is preferred that the hydroxyl groups of the modified polyol be etherified with allyl groups, the polyol having at least two allyl ether groups per polyol molecule. When the polyol is sucrose, it is preferred that the sucrose have at lease about five allyl ether groups per sucrose molecule. It is preferred that the polyether of the polyol comprise from about 0.1% to about 4% of the total monomers, more preferably from about 0.2% to about 2.5%.

Preferred monomeric olefinically unsaturated carboxylic acids for use in producing carboxyvinyl polymers used herein include monomeric, polymerizable, alpha-beta monoolefinically unsaturated lower aliphatic carboxylic acids; more preferred are monomeric monoolefinic acrylic acids of the structure

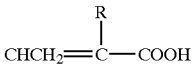

where R is a substituent selected from the group consisting of hydrogen and lower alkyl groups; for example, acrylic acid.

Various carboxyvinyl polymers, homopolymers and copolymers are commercially available from B. F. Goodrich Company, New York, N.Y., under the trade name Carbopol®. These polymers are also known as carbomers or polyacrylic acids. Carboxyvinyl polymers useful in formulations of the present invention include Carbopol 910 having a molecular weight of about 750,000, Carbopol 941 having a molecular weight of about 1,250,000, and Carbopols 934 and 940 having molecular weights of about 3,000,000 and 4,000,000, respectively. More preferred are the series of Carbopols which use ethyl acetate and cyclohexane in the manufacturing process, for example, Carbopol 981, 2984, 980, and 1382.

Preferred polycarboxylate polymers of the invention are non-linear, water-dispersible, polyacrylic acid cross-linked with a polyalkenyl polyether and having a molecular weight of at lease 750,000, preferably from about 750,000 to about 4,000,000.

Highly preferred examples of these polycarboxylate polyers for use in the present invention are Sokalan PHC-25®, a polyacrylic acid available from BASF Corporation, the Carbopol series resins available from B. F. Goodrich, and the Polygel series available from 3-V Chemical Corporation. Mixtures of polycarboxylate polymers as herein described may also be used.

The polycarboxylate polymer thickening agent can be used alone or with inorganic clays (e.g. aluminum silicate, bentonite, fumed silica). The preferred clay thickening agent can be either naturally occurring or synthetic. A preferred synthetic clay is the one disclosed in the U.S. Pat. No. 3,843,598, incorporated herein by reference. Naturally occurring clays include some smectite and attapulgite clays as disclosed in U.S. Pat. No. 4,824,590, incorporated herein by reference.

Other types of thickeners which can be used in this composition include natural gums, such as xanthan gum, locust bean gum, guar gum, and the like. Semi-synthetic thickeners such as the cellulosic type thickeners: hydroxyethyl and hydroxymethyl cellulose (ETHOCEL and METHOCEL® available from Dow Chemical) can also be used. Mixtures of polymeric thickening agents, semi-synthetic, and natural thickeners herein described may also be used.

In the preferred viscoelastic thixotropic liquid automatic dishwashing detergent composition, the polycarboxylate polymer thickening agent provides an apparent viscosity at high shear of greater than about 250 centipoise and an apparent yield value of from about 40 to about 800, and most preferably from about 60 to about 600, dynes/cm$^2$ to the composition.

Viscosity is a measure of the internal resistance to flow exhibited by a fluid in terms of the ratio of the shear stress to the shear rate. The yield value is an indication of the shear stress at which the gel strength is exceeded and flow is initiated. Yield value can be measured herein with a Brookfield RVT model viscometer with a T-bar B spindle at about 77° F. (25° C.) utilizing the Helipath drive during associated readings. The system is set to 0.5 rpm and a torque reading is taken for the composition to be tested after 30 seconds or after the system is stable. The system is stopped and the rpm is reset to 1.0 rpm. A torque reading is taken from the same composition after 30 seconds or after the system is stable. Apparent viscosities are calculated form the torque readings using factors provided with the Brookfield viscometer. An apparent Brookfield yield value is then calculated as: Brookfield Yield Value—(apparent viscosity at 0.5 rpm−apparent viscosity at 1 rpm)/100. This is the common method of calculation, published in Carbopol literature from the B. F. Goodrich Company and in other published references. In the cases of most of the formulations quoted herein, this apparent yield value is approximately four times higher than yield values calculated from shear rate and shear stress measurements in more rigorous rheological equipment.

Apparent viscosities at high shear are determined with a Brookfield RVT viscometer with spindle #6 at 100 rpm, reading the torque at 30 seconds.

A preferred method herein for measuring viscosity and yield value is with a Contraves Rheomat 115 viscometer which utilizes a Rheoscan 100 controller, a DIN 145 spindle and cup at 25° C. For viscosity measurements, the shear rate is increased from 0 to 150 sec$^{-1}$ over a 30 second time period. The viscosity, measured in centipoise, is taken at a shear rate of 150 sec$^{-1}$. Theshear rate for yield value measurements is increased linearly from 0 to 0.4 sec$^{-1}$ over a period of 500 seconds after an initial 5 minute rest period.

Additionally, a package which is substantially impermeable to water and carbon dioxide is preferred. Plastic bottles, including refillable or recyclable types, as well as conventional barrier cartons or boxes are generally suitable. When ingredients are not highly compatible, e.g., mixtures of silicates and citric acid, it may further be desirable to coat at least one such ingredient with a low-foaming nonionic surfactant for protection. There are numerous waxy materials which can readily be used to form suitable coated particles of any such otherwise incompatible components.

Detersive Enzymes (Including Enzyme Adjuncts)

The compositions of this invention may optionally, but preferably, contain from 0 to about 8%, preferably from about 0.001% to about 5%, more preferably from about 0.003% to about 4%, most preferably from about 0.005% to about 3%, by weight, of active detersive enzyme. The knowledgeable formulator will appreciate that different enzymes should be selected depending on the pH range of the ADD composition. Thus, Savinase® may be preferred in the instant compositions when formulated to deliver wash pH of 10, whereas Alcalase® may be preferred when the ADDs deliver wash pH of, say, 8 to 9. Moreover, the formulator will generally select enzyme variants with enhanced bleach compatibility when formulating oxygen bleaches containing compositions of the present invention.

In general, the preferred detersive enzyme herein is selected from the group consisting of proteases, amylases, lipases and mixtures thereof. Most preferred are proteases or amylases or mixtures thereof The proteolytic enzyme can be of animal, vegetable or microorganism (preferred) origin. More preferred is serine proteolytic enzyme of bacterial origin. Purified or nonpurified forms of enzyme may be used. Proteolytic enzymes produced by chemically or genetically modified mutants are included by definition, as are close structural enzyme variants. Particularly preferred by way of proteolytic enzyme is bacterial serine proteolytic enzyme obtained from Bacillus, *Bacillus subtilis* and/or *Bacillus licheniformis*. Suitable commercial proteolytic enzymes include Alcalase®, Esperase®, Durazym®, Savinase®, Maxatase®, Maxacal®, and Maxapem® 15 (protein engineered Maxacal); Purafect® and subtilisin BPN and BPN' are also commercially available. Preferred proteolytic enzymes also encompass modified bacterial serine proteases, such as those described in European Patent Application Serial No. 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine proteolytic enzyme which is called "Protease A" herein. Most preferred is what is called herein "Protease C", which is a triple variant of an alkaline serine protease from Bacillus in which tyrosine replaced valine at position 104, serine replaced asparagine at position 123, and alanine replaced threonine at position 274. Protease C is described in EP 90915958:4, corresponding to WO 91/06637, Published May 16, 1991, which is incorporated herein by reference. Genetically modified variants, particularly of Protease C, are also included herein. Some preferred proteolytic enzymes are selected from the group consisting of Savinase®, Esperase®, Maxacal®, Purafect®, BPN', Protease A and Protease B, and mixtures thereof Bacterial serine protease enzymes obtained from *Bacillus subtilis* and/or *Bacillus licheniformis* are preferred. An especially preferred protease herein referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76 in combination with one or more amino acid residue position equivalent to those selected from the group consisting of +99, +101, +103, +107 and +123 in Bacillus amyloliquefaciens subtilisin as described in the concurrently filed patent application of A. Baeck, C. K. Ghosh, P. P. Greycar, R. R. Bott and L. J. Wilson, entitled "Protease-Containing Cleaning Compositions" and having U.S. Ser. No. 08/136,797. This application is incorporated herein by reference.

Preferred lipase-containing compositions comprise from about 0.001 to about 0.01% lipase, from about 2% to about 5% amine oxide and from about 1% to about 3% low foaming nonionic surfactant.

Suitable lipases for use herein include those of bacterial, animal, and fungal origin, including those from chemically or genetically modified mutants. Suitable bacterial lipases include those produced by Pseudomonas, such as *Pseudomonas stutzeri* ATCC 19.154, as disclosed in British Patent 1,372,034, incorporated herein by reference. Suitable lipases include those which show a positive immunological cross-reaction with the antibody of the lipase produced from the microorganism Pseudomonas fluorescens IAM 1057. This lipase and a method for its purification have been described in Japanese Patent Application 53-20487, laid open on Feb. 24, 1978, which is incorporated herein by reference. This lipase is available under the trade name Lipase P "Amano," hereinafter referred to as "Amano-P." Such lipases should show a positive immunological cross reaction with the Amano-P antibody, using the standard and well-known immunodiffusion procedure according to Oucheterlon (Acta. Med. Scan., 133, pages 76–79 (1950)). These lipases, and a method for their immunological cross-reaction with Amano-P, are also described in U.S. Pat. No. 4,707,291, Thom et al., issued Nov. 17, 1987, incorporated herein by reference. Typical examples thereof are the Amano-P lipase, the lipase ex *Pseudomonas fragi* FERM P 1339 (available under the trade name Amano-B), lipase ex *Pseudomonas nitroreducens* var. *lipolyticum* FERM P 1338 (available under the trade name Amano-CES), lipases ex *Chromobacter viscosum* var.*lipolyticum* NRRlb 3673, and further *Chromobacter viscosum* lipases, and lipases ex *Pseudomonas gladioli*. A preferred lipase is derived from Pseudomonas pseudoalcaligenes, which is described in Granted European Patent, EP-B-0218272. Other lipases of interest are Amano AKG and Bacillis Sp lipase (e.g. Solvay enzymes). Additional lipases which are of interest where they are compatible with the composition are those described in EP A 0 339 681, published Nov. 28, 1990, EP A 0 385 401, published Sep. 5, 1990, EO A 0 218 272, published Apr. 15, 1987, and PCT/DK 88/00177, published May 18, 1989, all incorporated herein by reference.

Suitable fungal lipases include those produced by *Humicola lanuginosa* and *Thermomyces lanuginosus*. Most preferred is lipase obtained by cloning the gene from *Humicola lanuginosa* and expressing the gene in *Aspergillus oryzae* as described in European Patent Application 0 258 068, incorporated herein by reference, commercially available under the trade name LipolaseR from Novo-Nordisk.

Any amylase suitable for use in a dishwashing detergent composition can be used in these compositions. Amylases include for example, 2-amylases obtained from a special strain of *B. licheniforms*, described in more detail in British Patent Specification No. 1,296,839. Amylolytic enzymes include, for example, Rapidase™, Maxamyl™, Termamyl™ and BAN™. In a preferred embodiment, from about 0.001% to about 5%, preferably 0.005% to about 3%, by weight of active amylase can be used. Preferably from about 0.005% to about 3% by weight of active protease can be used. Preferably the amylase is Maxamyl™ and/or Termamyl™ and the protease is Savinase™ and/or protease B. As in the case of proteases, the formulator will use ordinary skill in selecting amylases or lipases which exhibit good activity within the pH range of the ADD composition.

Stability-Enhanced Amylase

Engineering of enzymes for improved stability, e.g., oxidative stability is known. See, for example J.Biological Chem., Vol. 260, No. 11, June 1985, pp 65.18–6521.

"Reference amylase" hereinafter refers to an amylase outside the scope of the amylase component of this invention and against which stability of an amylase within the invention can be measured.

The present invention also can makes use of amylases having improved stability in detergents, especially improved oxidative stability. A convenient absolute stability reference-point against which amylases used in the instant invention represent a measurable improvement is the stability of TERMAMYL (R) in is commercial use in 1993 and available from Novo Nordisk A/S. This TERMAMYL (R) amylase is a "reference amylase". Amylases within the spirit and scope of the present invention share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, all measured versus the above-identified reference-amylase. Preferred amylases herein can demonstrate further improvement versus more challenging reference amylases, the latter reference amylases being illustrated by any of the precursor amylases of which the amylases within the invention are variants. Such precursor amylases may themselves be natural or be the product of genetic engineering. Stability can be measured using any of the art-disclosed technical tests. See references disclosed in WO 94/02597, itself and documents therein referred to being incorporated by reference.

In general, stability-enhanced amylases respecting the invention can be obtained from Novo Nordisk A/S, or from Genencor International.

Preferred amylases herein have the commonality of being derived using site-directed mutagenesis from one or more of the Baccillus amylases, especially the Bacillus alpha-amylases, regardless of whether one, two or multiple amylase strains are the immediate precursors.

As noted, "oxidative stability-enhanced" amylases are preferred for use herein. Such amylases are non-limitingly illustrated by the following:

(a) An amylase according to the hereinbefore incorporated WO/94/02597, Novo Nordisk A/S, published Feb. 3, 1994, as further illustrated by a mutant in which substitution is made, using alanine or threonine (preferably threonine), of the methionine residue located in position 197 of the *B.licheniformis* alpha-amylase, known as TERMAMYL (R), or the homologous position variation of a similar parent amylase, such as *B. amyloliquefaciens, B.subtilis*, or *B.stearothermophilis;*

(b) Stability-enhanced amylases as described by Genencor International in a paper entitled "Oxidatively Resistant alpha-Amylases" presented at the 207th American Chemical Society National Meeting, Mar. 13–17 1994, by C.Mitchinson. Therein it was noted that bleaches in automatic dishwashing detergents inactivate alpha-amylases but that improved oxidative stability amylases have been made by Genencor from *B.licheniformis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE (R) and SUNLIGHT (R);

(c) Particularly preferred herein are amylase variants having additional modification in the immediate parent available from Novo Nordisk A/S. These amylases do not yet have a tradename but are those referred to by the supplier as QL37+M197T.

Any other oxidative stability-enhanced amylase can be used, for example as derived by site-directed mutagenesis from known chimeric, hybrid or simple mutant parent forms of available amylases.

Enzyme Stabilizing System

The stabilizing system of the ADDs herein may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger anions are widely available, indeed ubiquitous, and are illustrated by sots containing ammonium cations or sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc. and mixtures thereof can be used if desired. In general, since the chlorine scavenger function can be performed by several of the ingredients separately listed under better recognized functions, (e.g., other components of the invention including oxygen bleaches), there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any scavenger which is extremely incompatible with other optional ingredients, if used. For example, formulation chemists generally recognize that combinations of reducing agents such as thiosulfate with strong oxidizers such as percarbonate are not wisely made unless the reducing agent is protected from the oxidizing agent in the solid-form ADD composition. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Baginski et al.

Enzyme Stabilizing System

Preferred enzyme-containing compositions, especially liquid compositions, herein may comprise from about 0.001% to about 20%, preferably from about 0.005% to about 10%, most preferably from about 0.01% to about 8%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, vicinal polyol and mixtures thereof. The stabilizing system should also be compatible with the diacyl peroxide employed. For example, the polyol and/or glycol employed should fall outside the solubility parameter defined above.

Antioxidants (radiacal traps) may also be employed to stabilize enzymes against bleach decomposition. Suitable antioxidants are selected from the group consisting of BHT, BHA, α-tocopherol, Irganox series C (Ciba Giegy), Tenox series (Kodax) and mixtures thereof.

The stabilizing system of the ADDs herein may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger anions are widely available, indeed ubiquitous, and are illustrated by salts containing ammonium cations or sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc. and mixtures thereof can be used if desired. In general, since the chlorine scavenger function can be performed by several of the ingredients separately listed under better recognized functions, (e.g., other components of the invention including oxygen bleaches), there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any scavenger which is extremely incompatible with other optional ingredients, if used. For example, formulation chemists generally recognize that combinations of reducing agents such as thiosulfate with strong oxidizers such as percarbonate are not wisely made unless the reducing agent is protected from the oxidizing agent in the solid-form ADD composition. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Baginski et al.

Other Optional Bleaches

The compositions of the present invention can additionally contain an additional amount of oxygen bleach or chlorine bleach.

The oxyen bleach would be sufficient to provide from 0.01% to about 8%, preferably from about 0.1% to about 5.0%, more preferably from about 0.3% to about 4.0%, most preferably from about 0.8% to about 3% of available oxygen (AvO) by weight of the ADD.

Available oxygen of an ADD or a bleach component is the equivalent bleaching oxygen content thereof expressed as % O. For example, commercially available sodium perborate monohydrate typically has an available oxygen content for bleaching purposes of about 15% (theory predicts a maximum of about 16%). Methods for determining available oxygen of a formula after manufacture share similar chemical principles but depend on whether the oxygen bleach incorporated therein is a simple hydrogen peroxide source such as sodium perborate or percarbonate, is an activated type (e.g., perborate with tetra-acetyl ethylenediamine) or comprises a preformed peracid such as monoperphthalic acid. Analysis of peroxygen compounds is well-known in the art: see, for example, the publications of Swern, such as "Organic Peroxides", Vol. I, D. H. Swern, Editor; Wiley, New York, 1970, LC #72-84965, incorporated by reference. See for example the calculation of "percent active oxygen" at page 499. This term is equivalent to the terms "available oxygen" or "percent available oxygen" as used herein.

The peroxygen bleaching systems useful herein are those capable of yielding hydrogen peroxide in an aqueous liquor. These compounds include but are not limited to the alkali metal peroxides, organic peroxide bleaching compounds such as urea peroxide and inorganic persalt bleaching compounds such as the alkali metal perborates, percarbonates, perphosphates, and the like. Mixtures of two or more such bleaching compounds can also be used.

Preferred peroxygen bleaching compounds include sodium perborate, commercially available in the form of mono-, tri-, and tetra-hydrate, sodium pyrophosphate peroxyhydrate, urea peroxyhydrate, sodium percarbonate, and sodium peroxide. Particularly preferred are sodium perborate tetrahydrate, sodium perborate monohydrate and sodium percarbonate. Percarbonate is especially preferred because of environmental issues associated with boron. Many geographies are forcing legislation to eliminate elements such as boron from formulations.

Suitable oxygen-type bleaches are further described in U.S. Pat. No. 4,412,934 (Chung et al), issued Nov. 1, 1983, and peroxyacid bleaches described in European Patent Application 033,259. Sagel et al, published Sep. 13, 1989, both incorporated herein by reference, can be used.

Highly preferred percarbonate can be in uncoated or coated form. The average particle size of uncoated percarbonate ranges from about 400 to about 1200 microns, most preferably from about 400 to about 600 microns. If coated percarbonate is used, the preferred coating materials include carbonate, sulphate, silicate, borosilicate, fatty carboxylic acids, and mixtures thereof.

An inorganic chlorine belach ingredient such as chlorinated trisdoium phosphate can be utilized, but organic chlorine bleaches such as the chlorocyanurates are preferred. Water-soluble dichlorocyanurates such as sodium or potassium dichloroisocyanurate dihydrate are particularly preferred.

Available chlorine of an ADD component is the equivalent bleaching chlorine content thereof expressed as % equivalent $Cl_2$ by weight.

Activator

The optional peroxygen bleach component may be formulated with an activator (peracid precursor). The activator is present at levels of from about 0.01% to about 15%, preferably from about 1% to about 10%, more preferably from about 1% to about 8%, by weight of the composition. Preferred activators are selected from the group consisting of benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenylbenzoate (PhBz), decanoyloxybenzenesulphonate ($C_{10}$-OBS), benzolyvalerolactam (BZVL), octanoyloxybenzenesulphonate ($C_8$-OBS), perhydrolyzable esters and mixtures thereof, most preferably benzoylcaprolactam and benzolyvalerolactam. Preferred bleach activators are those described in U.S. Pat. No. 5,130,045, Mitchell et al, and U.S.

Pat. No. 4,412,934, Chung et al, and copending patent applications U.S. Ser. Nos. 08/064,624, 08/064,623, 08/064,621, 08/064,562, 08/064,564, 08/082,270 and copending application to M. Burns, A. D. Willey, R. T. Hartshorn, C. K. Ghosh, entitled "Bleaching Compounds Comprising Peroxyacid Activators Used With Enzymes" and having U.S. Ser. No. 08/133,691 (P&G Case 4890R), all of which are incorporated herein by reference.

The mole ratio of peroxygen bleaching compound (as AvO) to bleach activator in the present invention generally ranges from at least 1:1, preferably from about 20:1 to about 1:1, more preferably from about 10:1 to about 3:1.

Bleach Catalyst

The bleach catalyst material which can is an optional but preferable ingredient, can comprise the free acid form, the salts, and the like.

One type of bleach catalyst is a catalyst system comprising a transition metal cation of defined bleach catalytic activity, such as copper, iron, titanium, ruthenium, tungston, molybdenum or manganese cations, an auxiliary metal cation having little or no bleach catalytic activity, such as zinc or aluminum cations, and a sequestrate having defined stability constants for the catalytic and auxiliary metal cations, particularly ethylenedi-aminetetraacetic acid, ethylenediaminetetra(methylenephosphonic acid) and water-soluble salts thereof. Such catalysts are disclosed in U.S. Pat. No. 4,430,243.

Other types of bleach catalysts include the manganese-based complexes disclosed in U.S. Pat. Nos. 5,246,621 and 5,244,594. Preferred examples of theses catalysts include $Mn^{IV}{}_2(u\text{-}O)_3$(1,4,7-trimethyl-1,4,7-triazacyclononane)$_2$-$(PF_6)_2$, $Mn^{III}{}_2(u\text{-}O)_1(u\text{-}OAc)_2$(1,4,7-trimethyl-1,4,7-triazacyclononane)$_2$-$(ClO_4)_2$, $Mn^{IV}{}_4(u\text{-}O)_6$(1,4,7-triazacyclononane)$_4$-$(ClO_4)_2$, $Mn^{III}Mn^{IV}{}_4(u\text{-}O)_1(u\text{-}OAc)_2$ (1,4,7-trimethyl-1,4,7-triazacyclononane)$_2$-$(ClO_4)_3$, and mixtures thereof. Others are described in European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, and mixtures thereof.

The bleach catalysts useful in machine dishwashing compositions and concentrated powder detergent compositions may also be selected as appropriate for is the present invention. For examples of suitable bleach catalysts see U.S. Pat. Nos. 4,246,612 and 5,227,084.

See also. U.S. Pat. No. 5,194,416 which teaches mononuclear manganese (IV) complexes such as Mn(1,4,7-trimethyl-1,4,7-triazacyclononane$(OCH_3)_3$-$(PF_6)$.

Still another type of bleach catalyst, as disclosed in U.S. Pat. No. 5,114,606, is a water-soluble complex of manganese (II), (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose, and mixtures thereof. U.S. Pat. No. 5,114,611 teaches a bleach catalyst comprising a complex of transition metals; including Mn, Co, Fe, or Cu, with an non-(macro)-cyclic ligand. Said ligands are of the formula:

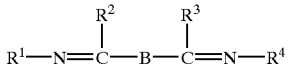

wherein $R^1$, $R^2$, $R^3$, and $R^4$ can each be selected from H, substituted alkyl and aryl groups such that each $R^1$—N═C—$R^2$ and $R^3$—C═N—$R^4$ form a five or six-membered ring. Said ring can further be substituted. B is a bridging group selected from O, S. $CR^5R^6$, $NR^7$ and C═O, wherein $R^5$, $R^6$, and $R^7$ can each be H, alkyl, or aryl groups, including substituted or unsubstituted groups. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co, Cu, Mn, Fe, -bispyridylmethane and -bispyridylamine complexes. Highly preferred catalysts include Co(2,2'-bispyridylamine)$Cl_2$, Di(isothiocyanato) bispyridylamine-cobalt (II), trisdipyridylamine-cobalt(II) perchlorate, Co(2,2-bispyridylamine)$_2O_2ClO_4$, Bis-(2,2'-bispyridylamine) copper(II) perchlorate, tris(di-2-pyridylamine) iron(II) perchlorate, and mixtures thereof.

Other examples include Mn gluconate, $Mn(CF_3SO_3)_2$, $Co(NH_3)_5Cl$, and the binuclear Mn complexed with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2]$-$(ClO_4)_3$.

The bleach catalysts of the present invention may also be prepared by combining a water-soluble ligand with a water-soluble manganese salt in aqueous media and concentrating the resulting mixture by evaporation. Any convenient water-soluble salt of manganese can be used herein. Manganese (II), (III), (IV) and/or (V) is readily available on a commercial scale. In some instances, sufficient manganese may be present in the wash liquor, but, in general, it is preferred to add Mn cations in the compositions to ensure its presence in catalytically-effective amounts. Thus, the sodium salt of the ligand and a member selected from the group consisting of $MnSO_4$, $Mn(ClO_4)_2$ or $MnCl_2$ (least preferred) are dissolved in water at molar ratios of ligand:Mn salt in the range of about 1:4 to 4:1 at neutral or slightly alkaline pH. The water may first be de-oxygenated by boiling and cooled by spraying with nitrogen. The resulting solution is evaporated (under $N_2$, if desired) and the resulting solids are used in the bleaching and detergent compositions herein without further purification.

In an alternate mode, the water-soluble manganese source, such as $MnSO_4$, is added to the bleach/cleaning composition or to the aqueous bleaching/cleaning bath which comprises the ligand. Some type of complex is apparently formed in situ, and improved bleach performance is secured. In such an in situ process, it is convenient to use a considerable molar excess of the ligand over the manganese, and mole ratios of ligand:Mn typically are 3:1 to 15:1. The additional ligand also serves to scavenge vagrant metal ions such as iron and copper, thereby protecting the bleach from decomposition. One possible such system is described in European patent application, publication no. 549,271.

While the structures of the bleach-catalyzing manganese.complexes of the present invention have not been elucidated, it may be speculated that they comprise chelates or other hydrated coordination complexes which result from the interaction of the carboxyl and nitrogen atoms of the ligand with the manganese cation. Likewise, the oxidation state of the manganese cation during the catalytic process is not known with certainty, and may be the (+II), (+III), (+IV) or (+V) valence state. Due to the ligands' possible six points of attachment to the manganese cation, it may be reasonably speculated that multi-nuclear species and/or "cage" structures may exist in the aqueous bleaching media. Whatever the form of the active Mn.ligand species which actually exists, it functions in an apparently catalytic manner to provide improved bleaching performances on stubborn stains such as tea, ketchup, coffee, wine, juice, and the like.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Quaternary substituted bleach activators may also be included. The present ADD compositions comprise a quaternary substituted bleach activator (QSBA) or a quaternary substituted peracid (QSP); more preferably, the former. Preferred QSBA structures are further described in copending U.S. Ser. Nos. 08/298,903, 08/298,650, 08/298,906 and 08/298,904 filed Aug. 31, 1994, incorporated herein by reference.

Silicates

The compositions of the type described herein optionally, but preferably comprise alkali metal silicates. The alkali metal silicates hereinafter described provide pH adjusting capability, protection against corrosion of metals and against attack on dishware, inhibition of corrosion to glasswares and chinawares. The $SiO_2$ level selected is such that the neat pH of the product stays within the pH range of 7–13, more preferably 9–11.5.

It has been found that at wash solutions of greater than pH 9.5 the presence of silicate (as $SiO_2$), especially at levels of greater than 11%, may negatively impact glasscare (i.e. glass corrosion). Therefore for overall enhanced performance, sodium silicate levels preferably should be kept at low levels and in the presence of low pH, preferably pH from about 7 to about 9.4, more preferably from about 8.5 to about 9.3.

Glasscare can be enhanced when the wash solution pH comprising a dissolved silicate containing ADD is less than 9.5, preferably from about 6.5 to about 9.5, more preferably from about 7.0 to about 9.3, most preferably from about 8.0 to about 9.2. Under these conditions the $SiO_2$ level is from about 0.5% to about 12%, preferably from about 1% to about 11%, more preferably from about 2% to about 10%, most preferably from about 3% to about 9%, based on the weight of the ADD. The ratio of $SiO_2$ to the alkali metal oxide ($M_2O$, where M=alkali metal) is typically from about 1 to about 3.2, preferably from about 1 to about 3, more preferably from about 1 to about 2.4. Preferably, the alkali metal silicate is hydrous, having from about 15% to about 25% water, more preferably, from about 17% to about 20%.

Anhydrous forms of the alkali metal silicates with a $SiO_2$:$M_2O$ ratio of 2.0 or more are also less preferred because they tend to be significantly less soluble than the hydrous alkali metal silicates having the same ratio.

Sodium and potassium, and especially sodium, silicates are preferred. A particularly preferred alkali metal silicate is a granular hydrous sodium silicate having a $SiO_2$:$Na_2O$ ratio of from 2.0 to 2.4 available from PQ Corporation, named Britesil H20 and Britesil H24. Most preferred is a granular hydrous sodium silicate having a $SiO_2$:$Na_2O$ ratio of 2.0. While typical forms, i.e. powder and granular, of hydrous silicate particles are suitable, preferred silicate particles have a mean particle size between about 300 and about 900 microns with less than 40% smaller than 150 microns and less, than 5% larger than 1700 microns. Particularly preferred is a silicate particle with a mean particle size between about 400 and about 700 microns with less than 20% smaller than 150 microns and less than 1% larger than 1700 microns.

Other suitable silicates include the crystalline layered sodium silicates have the general formula:

$$NaMSi_xO_{2x+1.y}H_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purpose of the present invention, x in the general formula above has a value of 2, 3 or 4 and is preferably s. The most preferred material is —$Na_2Si_2O_5$, available from Hoechst AG as NaSKS-6.

The crystalline layered sodium silicate material is preferably present in granular detergent compositions as a particulate in intimate admixture with a solid, water-soluble ionisable material. The solid, water-soluble ionisable material is selected from organic acids, organic and inorganic acid salts and mixtures thereof.

Low-Foaming Nonionic Surfactant

ADD compositions of the present invention can comprise low foaming nonionic surfactants (LFNIs). LFNI can be present in amounts from 0 to about 10% by weight, preferably from about 0.25% to about 4%. LFNIs are most typically used in ADDs on account of the improved water-sheeting action (especially from glass) which they confer to the ADD product. They also encompass non-silicone, phosphate or nonphosphate polymeric materials further illustrated hereinafter which are known to defoam food soils encountered in automatic dishwashing.

Preferred LFNIs include nonionic alkoxylated surfactants, especially ethoxylates derived from primary alcohols, and blends thereof with more sophisticated surfactants, such as the polyoxypropylene/polyoxyethylene/polyoxypropylene reverse block polymers. The PO/EO/PO polymer-type surfactants are well-known to have foam suppressing or defoaming action, especially in relation to common food soil ingredients such as egg.

In a preferred embodiment, the LFNI is an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkyl phenol on an average basis.

A particularly preferred LFNI is derived from a straight chain fatty alcohol containing from about 16 to about 20 carbon atoms ($C_{16}$–$C_{20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The LFNI can optionally contain propylene oxide in an amount up to about 15% by weight. Other preferred LFNI surfactants can be prepared by the processes described in U.S. Pat. No. 4,223,163, issued Sep. 16, 1980, Builloty, incorporated herein by reference.

Highly preferred ADDs herein wherein the LFNI is present make use of ethoxylated monohydroxy alcohol or alkyl phenol and additionally comprise a polyoxyethylene, polyoxypropylene block polymeric compound; the ethoxylated monohydroxy alcohol or alkyl phenol fraction of the LFNI comprising from about 20% to about 80%, preferably from about 30% to about 70%, of the total LFNI.

Suitable block polyoxyethylene-polyoxypropylene polymeric compounds that meet the requirements described herein before include those based on ethylene glycol, propylene glycol, glycerol, trimethylolpropane and ethylenediamine as initiator reactive hydrogen compound. Polymeric compounds made from a sequential ethoxylation and propoxylation of initiator compounds with a single reactive hydrogen atom, such as $C_{12-18}$ aliphatic alcohols, do not generally provide satisfactory suds control in the instant ADDs. Certain of the block polymer surfactant compounds designated PLURONIC® and TETRONIC® by the BASF-Wyandotte Corp., Wyandotte, Mich., are suitable in ADD compositions of the invention.

A particularly preferred LFNI contains from about 40% to about 70% of a polyoxypropylene/polyoxyethylene/polyoxypropylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene initiated with trimethylolpropane and containing 99 moles of propylene oxide and 24 moles of ethylene oxide per mole of trimethylolpropane.

Suitable for use as LFNI in the ADD compositions are those LFNI having relatively low cloud points and high hydrophilic-lipophilic balance (HLB). Cloud points of 1% solutions in water are typically below about 32° C. and preferably lower, e.g., 0° C., for optimum control of sudsing throughout a full range of water temperatures.

LFNIs which may also be used include a $C_{18}$ alcohol polyethoxylate, having a degree of ethoxylation of about 8, commercially available SLF18 from Olin Corp. and any biodegradable LFNI having the melting point properties discussed herein above. ps Anionic Co-surfactant The automatic dishwashing detergent compositions herein can additionally contain an anionic co-surfactant. When present, the anionic co-surfactant is typically in an amount from 0 to about 10%, preferably from about 0.1% to about 8%, more preferably from about 0.5% to about 5%, by weight of the ADD composition.

Suitable anionic co-surfactants include branched or linear alkyl sulfates and sulfonates. These may contain from about 8 to about 20 carbon atoms. Other anionic cosurfactants include the alkyl benzene sulfonates containing from about 6 to about 13 carbon atoms in the alkyl group, and mono- and/or dialkyl phenyl oxide mono- and/or di-sulfonates wherein the alkyl groups contain from about 6 to about 16 carbon atoms. All of these anionic co-surfactants are used as stable salts, preferably sodium and/or potassium.

Preferred anionic co-surfactants include sulfobetaines, betaines, alkyl(polyethoxy)sulfates (AES) and alkyl (polyethoxy)carboxylates which are usually high sudsing. Optional anionic co-surfactants are further illustrated in published British Patent Application No. 2,116,199A; U.S. Pat. No. 4,005,027, Hartman; U.S. Pat. No. 4,116,851, Rupe et al; and U.S. Pat. No. 4,116,849, Leikhim, all of which are incorporated herein by reference.

Preferred alkyl(polyethoxy)sulfate surfactants comprise a primary alkyl ethoxy sulfate derived from the condensation product of a $C_6$–$C_{18}$ alcohol with an average of from about 0.5 to about 20, preferably from about 0.5 to about 5, ethylene oxide groups. The $C_6$–$C_{18}$ alcohol itself is preferable commercially available. $C_{12}$–$C_{15}$ alkyl sulfate which has been ethoxylated with from about 1 to about 5 moles of ethylene oxide per molecule is preferred. Where the compositions of the invention are formulated to have a pH of between 6.5 to 9.3, preferably between 8.0 to 9, wherein the pH is defined herein to be the pH of a 1% solution of the composition measured at 20° C., surprisingly robust soil removal, particularly proteolytic soil removal, is obtained when $C_{10}$–$C_{18}$ alkyl ethoxysulfate surfactant, with an average degree of ethoxylation of from 0.5 to 5 is incorporated into the composition in combination with a proteolytic enzyme, such as neutral or alkaline proteases at a level of active enzyme of from 0.005% to 2%. Preferred alkyl (polyethoxy)sulfate surfactants for inclusion in the present invention are the $C_{12}$–$C_{15}$ alkyl ethoxysulfate surfactants with an average degree of ethoxylation of from 1 to 5, preferably 2 to 4, most preferably 3.

Conventional base-catalyzed ethoxylation processes to produce an average degree of ethoxylation of 12 result in a distribution of individual ethoxylates ranging from 1 to 15 ethoxy groups per mole of alcohol, so that the desired average can be obtained in a variety of ways. Blends can be made of material having different degrees of ethoxylation and/or different ethoxylate distributions arising from the specific ethoxylation techniques employed and subsequent processing steps such as distillation.

Alkyl(polyethoxy)carboxylates suitable for use herein include those with the formula $RO(CH_2CH_2O)xCH_2C00—M^+$ wherein R is a $C_6$ to $C_{18}$ alkyl group, x ranges from O to 10, and the ethoxylate distribution is such that, on a weight basis, the amount of material where x is 0 is less than about 20%, preferably less than about 15%, most preferably less than about 10%, and the amount of material where x is greater than 7, is less than about 25%, preferably less than about 15%, most preferably less than about 10%, the average x is from about 2 to 4 when the average R is $C_{13}$ or less, and the average x is from about 3 to 6 when the average R is greater than $C_{13}$, and M is a cation, preferably chosen from alkali metal, alkaline earth metal, ammonium, mono-, di-, and tri-ethanol-ammonium, most preferably from sodium, potassium, ammonium and mixtures thereof with magnesium ions. The preferred alkyl(polyethoxy) carboxylates are those where R is a $C_{12}$ to $C_{18}$ alkyl group.

Highly preferred anionic cosurfactants herein are sodium or potassium salt-forms for which the corresponding calcium salt form has a low Kraft temperature, e.g., 30° C. or below, or, even better, 20° C. or lower. Examples of such highly preferred anionic cosurfactants are the alkyl (polyethoxy)sulfates.

The preferred anionic co-surfactants of the invention in combination with the other components of the composition provide excellent cleaning and outstanding performance from the standpoints of residual spotting and filming. However, many of these co-surfactants may also be high sudsing thereby requiring the addition of LFNI, LFNI in combination with alternate suds suppressors as further disclosed hereinafter, or alternate suds suppressors without conventional LFNI components.

Silicone and Phosphate Ester Suds Suppressors

The ADDs of the invention can optionally contain an alkyl phosphate ester suds suppressor, a silicone suds suppressor, or combinations thereof Levels in general are from 0% to about 10%, preferably, from about 0.001% to about 5%. Typical levels tend to be low, e.g., from about 0.01% to about 3% when a silicone suds suppressor is used. Preferred non-phosphate compositions omit the phosphate ester component entirely.

Silicone suds suppressor technology and other defoaming agents useful herein are extensively documented in "Defoaming, Theory and Industrial Applications", Ed., P. R. Garrett, Marcel Dekker, N.Y., 1973, ISBN 0-8247-8770-6, incorporated herein by reference. See especially the chapters entitled "Foam control in Detergent Products" (Ferch et al) and "Surfactant Antifoams" (Blease et al). See also U.S. Pat. Nos. 3,933,672 and 4,136,045. Highly preferred silicone suds suppressors are the compounded types known for use in laundry detergents such as heavy-duty granules, although types hitherto used only in heavy-duty liquid detergents may also be incorporated in the instant compositions. For example, polydimethylsiloxanes having trimethylsilyl or alternate endblocking units may be used as the silicone. These may be compounded with silica and/or with surface-active nonsilicon components, as illustrated by a suds suppressor comprising 12% silicone/silica, 18% stearyl alcohol and 70% starch in granular form. A suitable commercial source of the silicone active compounds is Dow Corning Corp.

Levels of the suds suppressor depend to some extent on the sudsing tendency of the composition, for example, an ADD for use at 2000 ppm comprising 2% octadecyldimethylamine oxide may not require the presence of a suds suppressor. Indeed, it is an advantage of the present invention to select cleaning-effective amine oxides which are inherently much lower in foam-forming tendencies than the typical coco amine oxides. In contrast, formulations in which amine oxide is combined with a high-foaming anionic cosurfactant, e.g., alkyl ethoxy sulfate, benefit greatly from the presence of suds suppressors.

Phosphate esters have also been asserted to provide some protection of silver and silver-plated utensil surfaces, however, the instant compositions can have excellent silvercare without a phosphate ester component. Without being limited by theory, it is believed that lower pH formulations, e.g., those having pH of 9.5 and below, plus the presence of the essential amine oxide, both contribute to improved silver care.

If it is desired nonetheless to use a phosphate ester, suitable compounds are disclosed in U.S. Pat. No. 3,314,891, issued Apr. 18, 1967, to Schmolka et al, incorporated herein by reference. Preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof.

It has been found preferable to avoid the use of simple calcium-precipitating soaps as antifoams in the present compositions as they tend to deposit on the dishware. Indeed, phosphate esters are not entirely free of such problems and the formulator will generally choose to minimize the content of potentially depositing antifoams in the instant compositions.

Dispersant Polymer

Preferred compositions herein may additionally contain a dispersant polymer. When present, a dispersant polymer in the instant ADD compositions is compatible with the diacyl peroxide (i.e. does not solubilize the diacyl peroxide) and typically in the range from 0 to about 25%, preferably from about 0.5% to about 20%, more preferably from about 1% to about 7% by weight of the ADD composition. Dispersant polymers are useful for improved filming performance of the present ADD compositions, especially in higher pH embodiments, such as those in which wash pH exceeds about 9.5. Particularly preferred are polymers which inhibit the deposition of calcium carbonate or magnesium silicate on dishware.

Dispersant polymers suitable for use herein are illustrated by the film-forming polymers described in U.S. Pat. No. 4,379,080 (Murphy), issued Apr. 5, 1983, incorporated herein by reference.

Suitable polymers are preferably at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1000 to about 500,000, more preferably is from about 1000 to about 250,000, and most preferably, especially if the ADD is for use in North American automatic dishwashing appliances, is from about 1000 to about 5,000.

Other suitable dispersant polymers include those disclosed in U.S. Pat. No. 3,308,067 issued Mar. 7, 1967, to Diehl, incorporated herein by reference. Unsaturated monomeric acids that can be polymerized to form suitable dispersant polymers include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable provided that such segments do not constitute more than about 50% by weight of the dispersant polymer.

Copolymers of acrylamide and acrylate having a molecular weight of from about 3,000 to about 100,000, preferably from about 4,000 to about 20,000, and an acrylamide content of less than about 50%, preferably less than about 20%, by weight of the dispersant polymer can also be used. Most preferably, such dispersant polymer has a molecular weight of from about 4,000 to about 20,000 and an acrylamide content of from about 0% to about 15%, by weight of the polymer.

Particularly preferred dispersant polymers are low molecular weight modified polyacrylate copolymers. Such copolymers contain as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salt and have the general formula: —[(C($R^2$)C($R^1$)(C(O)O$R^3$)]—wherein the incomplete valencies inside the square braces are hydrogen and at least one of the substituents $R^1$, $R^2$ or $R^3$, preferably $R^1$ or $R^2$, is a 1 to 4 carbon alkyl or hydroxyalkyl group, $R^1$ or $R^2$ can be a hydrogen and $R^3$ can be a hydrogen or alkali metal salt. Most preferred is a substituted acrylic monomer wherein $R^1$ is methyl, $R^2$ is hydrogen and $R^3$ is sodium.

The low molecular weight polyacrylate dispersant polymer preferably has a molecular weight of less than about 15,000, preferably from about 500 to about 10,000, most preferably from about 1,000 to about 5,000. The most preferred polyacrylate copolymer for use herein has a molecular weight of 3500 and is the fully neutralized form of the polymer comprising about 70% by weight acrylic acid and about 30% by weight methacrylic acid.

Other suitable modified polyacrylate copolymers include the low molecular weight copolymers of unsaturated aliphatic carboxylic acids disclosed in U.S. Pat. Nos. 4,530,766, and 5,084,535, both incorporated herein by reference.

Preferred polymers also include polyacrylates with an average molecular weight of from about 1,000 to about 10,000, and acrylate/maleate or acrylate/fumarate copolymers with an average molecular weight of from about 2,000 to about 80,000 and a ratio of acrylate to maleate or fumarate segments of from about 30:1 to about 1:2. Examples of such copolymers based on a mixture of unsaturated mono- and dicarboxylate monomers are disclosed in European Patent Application No. 66,915, published Dec. 15, 1982, incorporated herein by reference.

Other dispersant polymers useful herein include the polyethylene glycols and polypropylene glycols having a molecular weight of from about 950 to about 30,000 which can be obtained from the Dow Chemical Company of Midland, Mich. Such compounds for example, having a melting point within the range of from about 30° to about 100° C. can be obtained at molecular weights of 1450, 3400, 4500, 6000, 7400, 9500, and 20,000. Such compounds are formed by the polymerization of ethylene glycol or propylene glycol with the requisite number of moles of ethylene or propylene oxide to provide the desired molecular weight and melting point of the respective and polypropylene glycol. The polyethylene, polypropylene and mixed glycols are referred to using the formula $HO(CH_2CH_2O)_m(CH_2CH(CH_3)O)_n(CH(CH_3)CH_2O)OH$ wherein m, n, and o are integers satisfying the molecular weight and temperature requirements given above.

Yet other dispersant polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable dispersant polymers are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,929,107, Thompson, issued Nov. 11, 1975; the hydroxyalkyl starch ethers, starch esters, oxidized starches, dextrins and starch hydrolysates described in U.S. Pat No. 3,803,285, Jensen, issued Apr. 9, 1974; the carboxylated starches described in U.S. Pat. No. 3,629,121, Eldib, issued Dec. 21, 1971; and the dextrin starches described in U.S. Pat. No. 4,141,841, McDanald, issued Feb. 27, 1979; all incorporated herein by reference. Preferred cellulose-derived dispersant polymers are the carboxymethyl celluloses.

Yet another group of acceptable dispersants are the organic dispersant polymers, such as polyaspartate.

Corrosion Inhibitor

The present compositions may also contain corrosion inhibitor. Such corrosion inhibitors are preferred components of machine dishwashing compositions in accord with the invention, and are preferably incorporated at a level of from 0.05% to 10%, preferably from 0.1% to 5% by weight of the total composition.

Suitable corrosion inhibitors include paraffin oil typically a predominantly branched aliphatic hydrocarbon having a number of carbon atoms in the range of from 20 to 50: preferred paraffin oil selected from predominantly branched $C_{25-45}$ species with a ratio of cyclic to noncyclic hydrocarbons of about 32:68; a paraffin oil meeting these characteristics is sold by Wintershall, Salzbergen, Germany, under the trade name WINOG 70.

Other suitable corrosion inhibitor compounds include benzotriazole and any derivatives thereof, mercaptans and diols, especially mercaptans with 4 to 20 carbon atoms including lauryl mercaptan, thiophenol, thionapthol, thionalide and thioanthranol. Also suitable are the $C_{12}$–$C_{20}$ fatty acids, or their salts, especially aluminum tristearate. The $C_{12}$–$C_{20}$ hydroxy fatty acids, or their salts, are also suitable. Phosphonated octa-decane and other anti-oxidants such as betahydroxytoluene (BHT) are also suitable.

Other Optional Adjuncts

Hydrotrope materials such as sodium benzene sulfonate, sodium toluene sulfonate, sodium cumene sulfonate, etc., can be present in minor amounts.

Bleach-stable perfumes (stable as to odor); and bleach-stable dyes (such as those disclosed in U.S. Pat. No. 4,714,562, Roselle et al, issued Dec. 22, 1987); can also be added to the present compositions in appropriate amounts. Other common detergent ingredients are not excluded.

Method for Cleaning

The present invention also encompasses methods for cleaning soiled tableware. A preferred method comprises contacting the tableware with a pH wash aqueous medium of at least 8. The aqueous medium comprising at least about 0.01% diacyl peroxide, at least about 20% solvent having a solubility parameter of less than or greater than about 4 of the solubitlity parameter of said diacyl peroixide and at least 0.01% chelant.

The aqueous medium is formed by dispersing a liquid, alkaline detergent composition in a washing or dishwashing machine. A particularly preferred method also includes detersive enzymes, preferably from about 0.001% to about 5%.

The following examples illustrate the compositions of the present invention. These examples are not meant to limit or otherwise define the scope of the invention. All parts, percentages and ratios used herein are expressed as percent weight unless otherwise specified.

EXAMPLE 1

Liquid automatic dishwashing detergent of the present invention wherein increased levels of stain removal benefits are achieved are as follows:

TABLE 1

| | % by weight of active material | | | | | | | | |
|---|---|---|---|---|---|---|---|---|---|
| INGREDIENTS | A | B | C | D | E | F | G | H | I |
| Citric acid | 16.5 | 16.5 | 16.5 | 16.5 | 16.5 | 10 | 10 | 10 | 10 |
| Na2CO3/K2CO3 | — | — | 25 | 25 | 25 | 15 | 15 | 15 | 15 |
| Silicate | | | | | | | | | |
| Dispersant (480N) | 4 | 4 | 4 | 4 | 4 | 4 | 4 | 4 | 4 |
| HEDP/SS-EDDS | 2 | 2 | 0–2 | 2 | 2 | 1.5 | 1.5 | 1.5 | 1.5 |
| Benzoyl Peroxide | 8 | 8 | 8 | 8 | 8* | 1.5 | 1.5 | 1.5 | 1.5 |
| Butylated Hydroxy Toluene (BHT) | 0.05 | 0.05 | 0.05 | 0.05 | 0.05 | 0.05 | 0.05 | 0.05 | 0.05 |
| Surfactant | 2.5 | 2.5 | 1.5 | 1.5 | 1.5 | 1.5 | 1.5 | 1.5 | 1.5 |
| Boric acid | — | 4 | 4 | 4 | 4 | 4 | 4 | — | — |
| Sorbitol | — | 6 | 6 | 6 | 6 | 6 | 6 | — | — |

TABLE 1-continued

| | % by weight of active material | | | | | | | | |
|---|---|---|---|---|---|---|---|---|---|
| INGREDIENTS | A | B | C | D | E | F | G | H | I |
| Peptide aldehyde | — | — | — | — | — | — | — | .002 & .005 | .002 & .005 |
| Cationic proteins | — | — | — | — | — | — | — | — | — |
| Carboxylic acids | — | — | — | — | — | — | — | — | — |
| Savinase 24L | — | — | — | — | — | 0.53 | — | 0.53 | — |
| Slurried Savinase 16L | — | — | — | — | — | — | 0.53 | — | 0.53 |
| Maxamyl/Termamy | — | — | — | — | — | 0.31 | — | 0.31 | — |
| Slurried Termamyl 300KL | — | — | — | — | — | — | 0.31 | — | 0.31 |
| Water | | | | | Balance | | | | |
| Neat pH of product by Na/K hydroxide | 9 | 9–12.9 | 11 | 11–12.5 | 11 | 11 | 11 | 11 | 11 |
| IPA | 6 | — | — | — | — | — | — | — | — |
| | | | | | 100 for | | | | |
| | | | 100 below | | HEDP = 100 below | | | | |
| % BzP stable after 2 wks @ 100 F. | 88 | pH <= 11.5 | 1.5 | pH, +11 | 60 | 100 | 100 | 100 | 100 |

*3–10 micron size particles

What is claimed is:

1. A liquid, alkaline detergent composition, comprising, by weight of said composition:

a) from about 0.01% to about 10% of particles comprising diacyl peroxide, b) from about 20% to about 90% solvent having a solubility parameter value outside about ±4 of said diacyl peroxide's solubility parameter, and c) from about 0.01% to about 10% chelant, said chelant selected from the group consisting of sodium, potassium, lithium, ammonium, and substituted ammonium salts of ethylenediamine tetraacetic acid, ethylenediamine disuccinic acid, nitrilotriacetic acid, tartrate monosuccinic acid, tartrate disuccinic acid, oxydisuccinic acid, carboxytethyloxysuccinic acid, mellatic acid, sodium benzene polycarboxylate salts, nitrilotris (methylene phosphonic acid), diethylenetrinitrilopentakis(methylenephosphonic acid), 1-hydroxyethane-1,1-diphosphonic acid, ethylene-N,N'-bis(o-hydroxy-phenylgycine), dipliolinic acid, diethylene triamine penta (methylene phosphonate), hexamethylene diamine tetra(methylene phosphonoate), ethylenediaminotetracetic acid, ethylenetriamine pentacetic acid, ethylenediamine-N,N'-disuccinic, iminodiacetic acid derivatives, acid, ethylene diphosphonic acid, organo phosphonic acid, and mixtures thereof, wherein the particles of diacyl peroxide are free from coatings capable of inhibiting dissolution and said composition has a neat pH from about 7 to about 13.

2. The composition according to claim 1, wherein the particles consist essentially of diacyl peroxide.

3. The composition according to claim 1, wherein the particles consist of diacyl peroxide.

4. The composition according to claim 1, wherein the particles have a size greater than 10$\mu$.

5. The composition according to claim 1, wherein the particles have a size of from about 100$\mu$ to about 2000$\mu$.

6. The composition according to claim 1, further comprising an additional peroxygen bleaching system comprising:

(i) from about 0.1% to about 8% available oxygen added as a peroxygen bleach compound selected from the group consisting of percarbonate, perborate, persulphate, and mixtures thereof; and (ii) from about 0.01% to about 15% peroxygen bleach activator selected from the group consisting of benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenylbenzoate (PhBz), decanoyloxybenzenesulphonate ($C_{10}$-OBS), benzolyvalerolactam (BZVL), octanoyloxybenzenesulphonate ($C_8$-OBS), perhydrolyzable exters, and mixtures thereof;

wherein the mole ratio of peroxygen bleaching compound (as AvO) to bleach activator ranges from at least from about 20:1 to about 1:1.

7. A composition according to claim 1, wherein saiddiacyl peroxide is selected from the group consisting of dibenzoyl peroxide, benzoyl gluaryl peroxide, benzoyl succinyl peroxide, di-(2-methylbenzoyl)peroxide, diphthaloyl peroxide; and mixtures thereof.

8. A composition according to claim 1, wherein said chelant is selected from the group consisting of nitrilotriacetic acid and polyaminocarboxylic acids selected from the group consisting of ethylene diphosphonic acid, 1-hydroxyethane-1,1-diphosphonic acid, ethylenediaminotetracetic acid, ethylenetriamine pentacetic acid, ethylenediamine disuccinic acid, organo disphophonic, and mixtures thereof.

9. A composition according to claim 8, further comprising from about 0.9% to about 99% by weight of a pH adjusting component of a salt or salt/builder mixture selected from the group consisting of:

(i) sodium or potassium carbonate or sesquicarbonate;

(ii) sodium or potassium citrate;

(iii) citric acid;

(iv) sodium or potassium bicarbonate;

(v) sodium or potassium borate;

(vi) sodium or potassium hydroxide;

(vii) phosphate builders; and (viii) mixture(s) thereof.

10. A composition according to claim 9 further comprising from about 0.001% to about 5% of a detersive enzyme.

11. A composition according to claim 6 further comprising a bleach catalyst selected from the group consisting of $Mn^{IV}{}_2$(u-O)$_3$(1,4,7-trimethyl-1,4,7-triacylononane)$_2$-(PF$_6$)$_2$, $Mn^{III}{}_2$(u-O)$_1$(u-OAc)$_2$(1,4,7-tri-methyl-1,4,7-triacyclononane)$_2$-(ClO$_4$)$_2$; $Mn^{IV}{}_4$(u-O)$_6$(1,4,7-triacyclononane)$_4$-(ClO$_4$)$_2$; $Mn^{III}Mn^{IV}{}_4$(u-O)$_1$(u-OAc)$_2$(1,4,7-trimethyl-1,4,7-triacyclononane)$_2$-(ClO$_4$)$_3$; Mn(1,4,7-trimethyl-1,4,7-triazacyclononane(OCH$_3$)$_3$-(PF$_6$); Co(2,2'-bispyridylamine)Cl$_2$; Di-(isothiocyanato)bispyridylamine-cobalt (II); tridipyridylamine-cobalt (II) percholrate; Co(2,2-bispyridylamine)$_2$-O$_2$ClO$_4$; Bis-(2,2'-bispyridylamine) copper(II) perchlorate; tris(di-2-pyridylamine)iron (II) perchlorate; Mn gluconate; Mn(CF$_3$SO$_3$)$_2$; Co(NH$_3$)$_5$Cl; binuclear Mn complexed with tetra-N-dentate and bi-N-dentate ligands, $N_4Mn^{III}$(u-O)$_2MN^{IV}N_4)^+$ and [Bipy$_2Mn^{III}$(u-O)$_2Mn^{IV}$bipy$_2$]-(ClO$_4$)$_3$ and mixtures thereof.

12. A composition according to claim 10 further comprising from about 0.5% to about 12% $SiO_2$.

13. A composition according to claim 1, wherein said solvent is selected from the group consisting of water, glycerol, dimethyl siloxane, sorbitol and mixtures thereof.

14. A composition according to claim 13, wherein said diacyl peroxide is dibenzyol peroxide.

15. A composition according to claim 14 further comprising from about 0.5% to about 20% of a dispersant polymer selected from the group consisting of polyacrylates and polyacrylate copolymers.

16. A composition according to claim 15 wherein said composition provides a wash solution pH of from about 9.0 to about 12.0.

17. A composition according to claim 16 further comprising from about 0.1% to about 10% of a low foaming nonionic surfactant.

18. A composition according to claim 17 wherein said low foaming nonionic surfactant is selected from the group consisting of alkoxylated alcohols, glucosamides and mixtures thereof.

19. A composition according to claim 18 wherein said composition has a neat pH from about 9 to about 11.5.

20. A composition according to claim 10 wherein said detersive enzyme is selected from the group consisting of protease, amylase, lipase and mixtures thereof.

21. A composition according to claim 20 comprising from about 0.005 to about 3% by weight protease or amylase.

22. A composition according to claim 20 further comprising from about 0.01% to about 20% by weight of an enzyme stabilizing system.

* * * * *